US011584133B2

(12) United States Patent
Nakazawa et al.

(10) Patent No.: US 11,584,133 B2
(45) Date of Patent: Feb. 21, 2023

(54) INK TANK AND IMAGE RECORDING APPARATUS

(71) Applicant: BROTHER KOGYO KABUSHIKI KAISHA, Nagoya (JP)

(72) Inventors: Fumio Nakazawa, Okazaki (JP); Yoshinori Osakabe, Seto (JP); Naoya Okazaki, Hashima-gun (JP); Satoru Oki, Nagoya (JP); Masahiro Hayashi, Nishio (JP); Nanami Ashida, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/474,287

(22) Filed: Sep. 14, 2021

(65) Prior Publication Data

US 2022/0097391 A1 Mar. 31, 2022

(30) Foreign Application Priority Data

Sep. 30, 2020 (JP) ..... JP2020-166291

(51) Int. Cl.
*B41J 2/175* (2006.01)

(52) U.S. Cl.
CPC ..... *B41J 2/17509* (2013.01); *B41J 2/1754* (2013.01); *B41J 2/17513* (2013.01); *B41J 2/17553* (2013.01); *B41J 2/17596* (2013.01)

(58) Field of Classification Search
CPC ..... B41J 2/17503; B41J 2/17506; B41J 2/17509; B41J 2/17513; B41J 2/17533; B41J 2/1754; B41J 2/17546; B41J 2/17553; B41J 2/17566; B41J 2/17596; B41J 2002/17573; B41J 29/02; B41J 29/13

See application file for complete search history.

(56) References Cited

U.S. PATENT DOCUMENTS

2007/0206075 A1* 9/2007 Bulman ..... B41J 2/17509 347/86
2020/0238742 A1* 7/2020 Cantrell ..... B41J 1/00

FOREIGN PATENT DOCUMENTS

WO 2019-078898 A1 4/2019

* cited by examiner

*Primary Examiner* — Anh T Vo
(74) *Attorney, Agent, or Firm* — Merchant & Gould P.C.

(57) ABSTRACT

An ink tank includes: a first liquid storage chamber; a second liquid storage chamber communicating with the first liquid storage chamber through a communication passage; an injector having an opening supplying liquid to the first liquid storage chamber; a cap movable between an open position and a closed position with respect to the injector; a slide member which is inserted so as to be vertically movable with respect to the opening of the injector, the slide member being moved downward by the cap in the closed position; a valve body which is vertically movably inserted in the communication passage and includes a first sealing member opening the communication passage by moving downward together with the slide member moved downward by the cap in the closed position; and an urging member always urging the valve body upward.

9 Claims, 9 Drawing Sheets

INK TANK AND IMAGE RECORDING APPARATUS

CROSS-REFERENCE TO RELATED APPLICATIONS

This application is based on and claims priority under 35 USC 119 from Japanese Patent Application No. 2020-166291 filed on Sep. 30, 2020, the contents of which are incorporated herein by reference.

TECHNICAL FIELD

The present disclosure relates to an ink tank and an image recording apparatus including the ink tank.

BACKGROUND

In a recent year, there is an image recording apparatus having an ink tank capable of filling and refilling ink. FIG. 1A illustrates an example of an image recording apparatus 300. As illustrated in FIG. 1A, the image recording apparatus 300, which is an example of the inkjet recording apparatus, has a substantially rectangular parallelepiped shape. The image recording apparatus 300 includes a scanner above the image recording apparatus 300, which reads an image recorded on a document such as paper by an image sensor (not illustrated) and acquires image data. Further, a printer for recording an image on a sheet is provided in a lower part of the image recording apparatus 300. The printer includes an inkjet recording type recording head 310 as an example of a liquid consumption device.

In the following description, an up-down direction is defined with reference to a posture (the posture illustrated in FIGS. 1A and 1B and it may be referred to as "usage posture") in which the image recording apparatus 300 with an ink tank 303 mounted is installed in a horizontal plane for use. Further, a front-rear direction is defined with a side on which an opening and closing cover 307 is provided as a front side and a left-right direction is defined when the image recording apparatus 300 is viewed from the front side. In the illustrative embodiment, in the usage posture, the up-down direction corresponds to a vertical direction and the front-rear direction and the left-right direction correspond to a horizontal direction.

In the image recording apparatus 300 of FIG. 1A, the opening and closing cover 307 which can be opened or closed is in an open position. In the image recording apparatus 300, three ink tanks 303 in which three colors of CMY (Cyan, Magenta, Yellow) ink are stored are arranged on a front left side of the device. Of these three ink tanks 303, a cap 304 of the leftmost ink tank 303 is in an open position and caps 304 of the other two ink tanks 303 are in a closed position. On the other hand, an ink tank 303 containing BK (Black) ink is arranged on a front right side of the image recording apparatus 300. A cap 304 of the ink tank 303 for BK is in the closed position. When the opening and closing cover 307 is in the open position, a user can access these ink tanks 303, that is, supply or replenish ink. FIG. 1B is an enlarged view of a front portion 302 of the three ink tanks 303 arranged on the front left side.

Next, a schematic structure of the ink tank 303 of the related art mounted on the image recording apparatus 300 will be described with reference to FIGS. 2 to 4B. FIG. 2 is a left side view of the ink tank 303. FIG. 3 is a perspective view illustrating only a link mechanism 200 used in the ink tank 303 by extracting it. FIG. 4A is a schematic view illustrating the ink tank 303 in a state where a sealing member 209 of a valve body 207 seals a communication passage 220 which communicates a first ink chamber 301 and a second ink chamber 401 with the cap 304 in an open position and FIG. 4B is a schematic view illustrating the ink tank 303 in a state where the sealing member 209 of the valve body 207 opens the communication passage 220 which communicates the first ink chamber 301 and the second ink chamber 401 with the cap 304 in a closed position. However, FIGS. 4A and 4B do not show the second ink chamber 401 provided below the first ink chamber 301.

In the ink tank 303, the cap 304 is rotatably attached to an ink tank body 306. The cap 304 is able to seal an injection cylinder 305. The cap 304 is always urged from the closed position to the open position by an elastic body (rubber O-ring as an example) (not illustrated). When an engagement that holds the cap 304 in the closed position is released, the cap 304 rotates by itself from the closed position in which the injection cylinder is sealed to the open position. Further, the cap 304 includes a protrusion 201 which extends downward when in the closed position. When the cap 304 is in the open position, the protrusion 201 is separated from a slider member 202 described below. However, when the cap 304 is in the closed position, the protrusion 201 presses the slider member 202 downward.

Next, the link mechanism 200 will be described with reference to FIG. 3. The link mechanism 200 is a mechanism for connecting the cap 304 and the valve body 207 in order to link an operation of the cap 304 with an operation of the valve body 207 described below.

The link mechanism 200 is composed of the slider member 202, a second lever arm 203, a first lever arm 206, a compression spring 204, a plurality of rubber O-rings, and the like.

The slider member 202, the second lever arm 203, and the compression spring 204 are arranged on the outside of the ink tank 303, that is, on a right wall of the ink tank 303. Further, a rotation shaft 205 of the first lever arm 206 penetrates a through hole 205A provided in the right wall forming the first ink chamber 301 from the inside of the first ink chamber 301 toward the outside of the ink tank 303. The through hole 205A is provided with an O-ring or the like (not illustrated) so that the ink in the first ink chamber 301 does not leak from the through hole 205A. Then, the first lever arm 206 can rotate in the first ink chamber 301 with the rotation shaft 205 as a center of rotation in conjunction with a rotation operation of the second lever arm 203 arranged on the right side wall of the ink tank 303.

The valve body 207 includes the seal member 209 which seals a communication passage 220 which communicates the first ink chamber 301 and the second ink chamber 401 and is rotatably coupled to the first lever arm 206. Then, the valve body 207 moves up and down as the slider member 202 moves, the second lever arm 203 rotates, and the first lever arm 206 rotates as the cap 304 opens or closes. As a result, the seal member 209 sits or separates from a valve seat 210 to open or close the communication passage 220 which communicates the first ink chamber 301 and the second ink chamber 401.

In addition, the ink tank 303 includes an ink outlet 360 for supplying ink to a recording head 310 and an atmospheric communication port 370 for communicating the inside of the second ink chamber 401 to the outside of the ink tank 303. The ink outlet 360 is provided in the second ink chamber 401. Although the atmospheric communication port 370 is provided at an upper portion of the ink tank 303, an atmospheric communication passage 371 for communicating the atmospheric communication port 370 with the inside of the second ink chamber 401 extends to the second ink chamber 401.

Further, the ink tank 303 is provided with a visual recognition portion 350 on a front side of the ink tank body 306. Since the ink tank body 306 is made of a resin which transmits light rays or a translucent resin, a user can check a remaining amount of ink in the ink tank 303 simply by looking at the visual recognition portion 350. The visual recognition portion 350 is provided with an upper limit indicator 351 and a lower limit indicator 352. The upper limit indicator 351 displays a liquid level height of a maximum capacity of ink which can be stored in the ink tank 303. On the other hand, the lower limit indicator 352 displays a liquid level height which encourages a user to inject ink into the ink tank 303.

SUMMARY

One illustrative aspect of the present disclosure provides an ink tank configured to supply liquid to an apparatus having a liquid consumption device, the ink tank comprising: a first liquid storage chamber configured to store liquid to be supplied to the liquid consumption device; a second liquid storage chamber communicating with the first liquid storage chamber through a communication passage, the second liquid storage chamber having a liquid outlet supplying liquid to the liquid consumption device; an injector having an opening supplying liquid to the first liquid storage chamber; a cap movable between an open position and a closed position with respect to the injector; a slide member which is inserted so as to be vertically movable with respect to the opening of the injector, the slide member being moved downward by the cap in the closed position; a valve body which is vertically movably inserted in the communication passage between the first liquid storage chamber and the second liquid storage chamber, the valve body comprising a first sealing member configured to seal the communication passage, the first sealing member opening the communication passage by moving downward together with the slide member moved downward by the cap in the closed position; and an urging member configured to always urge the valve body upward.

According to the disclosure, it is possible to provide an ink tank having a simple structure and can prevent liquid leakage.

BRIEF DESCRIPTION OF DRAWINGS

Illustrative embodiments of the present disclosure will be described in detail based on the following figures, wherein:

FIG. 1A illustrates a perspective view of an image recording apparatus 300 with an opening and closing cover 307 open and FIG. 1B illustrates a partially enlarged view of the image recording apparatus 300;

FIG. 4A illustrates a schematic view of a state in which a valve body 207 seals a communication passage 220 by separating the cap 304 in an open position from a link mechanism and FIG. 4B illustrates a schematic view of a state in which the valve body 207 opens the communication passage 220 by operating the link mechanism by the cap 304 in a closed position;

FIG. 8A illustrates a schematic view of a state in which a valve body 520 opens a communication passage 531 by pushing the valve body 520 downward by a cap 502 in a closed position and FIG. 8B illustrates a schematic view of a state in which the valve body 520 seals the communication passage 531 by separating the cap 502 in an open position from the injection cylinder 510; FIG. 9A illustrates a schematic view of a state in which a cap 802 in a closed position pushes down an injection cylinder 810 and FIG. 9B illustrates a schematic view of a state in which the cap 802 in an open position is separated from the injection cylinder 810.

DETAILED DESCRIPTION

Figures 1A, 1B:
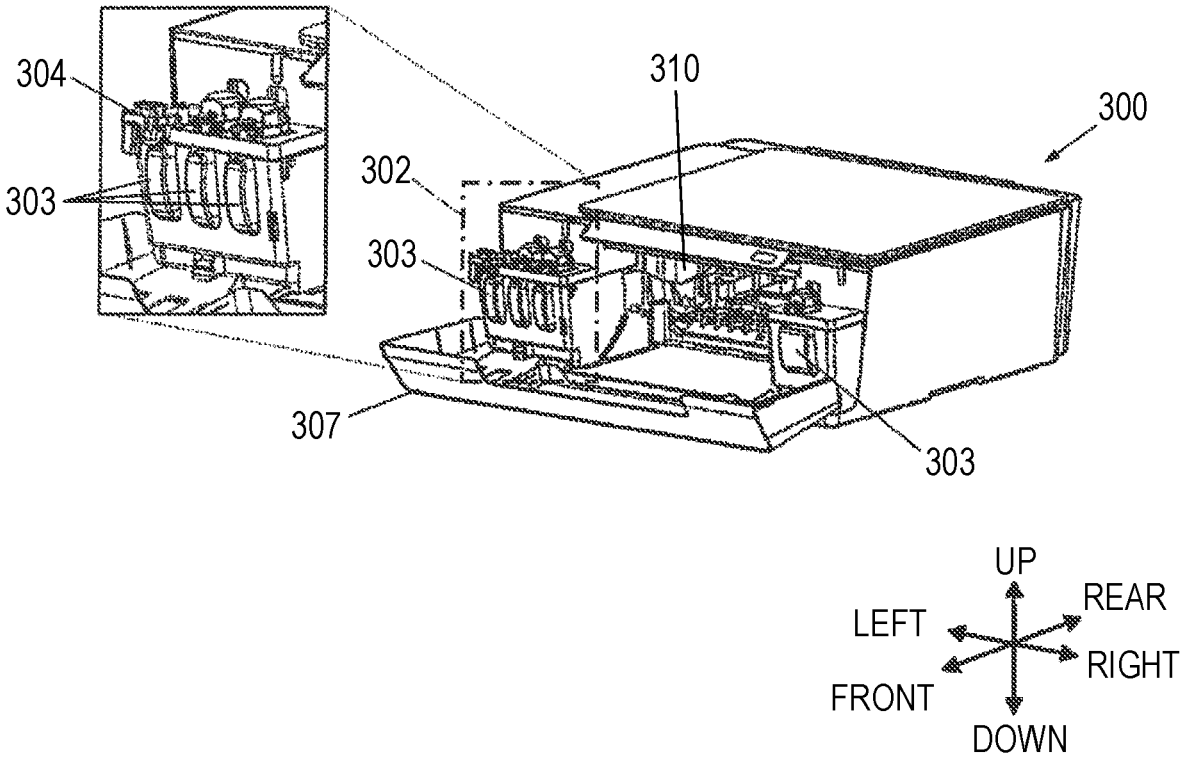
FIGS. 1A and 1B are perspective views of an image recording apparatus, where
Figure 2:
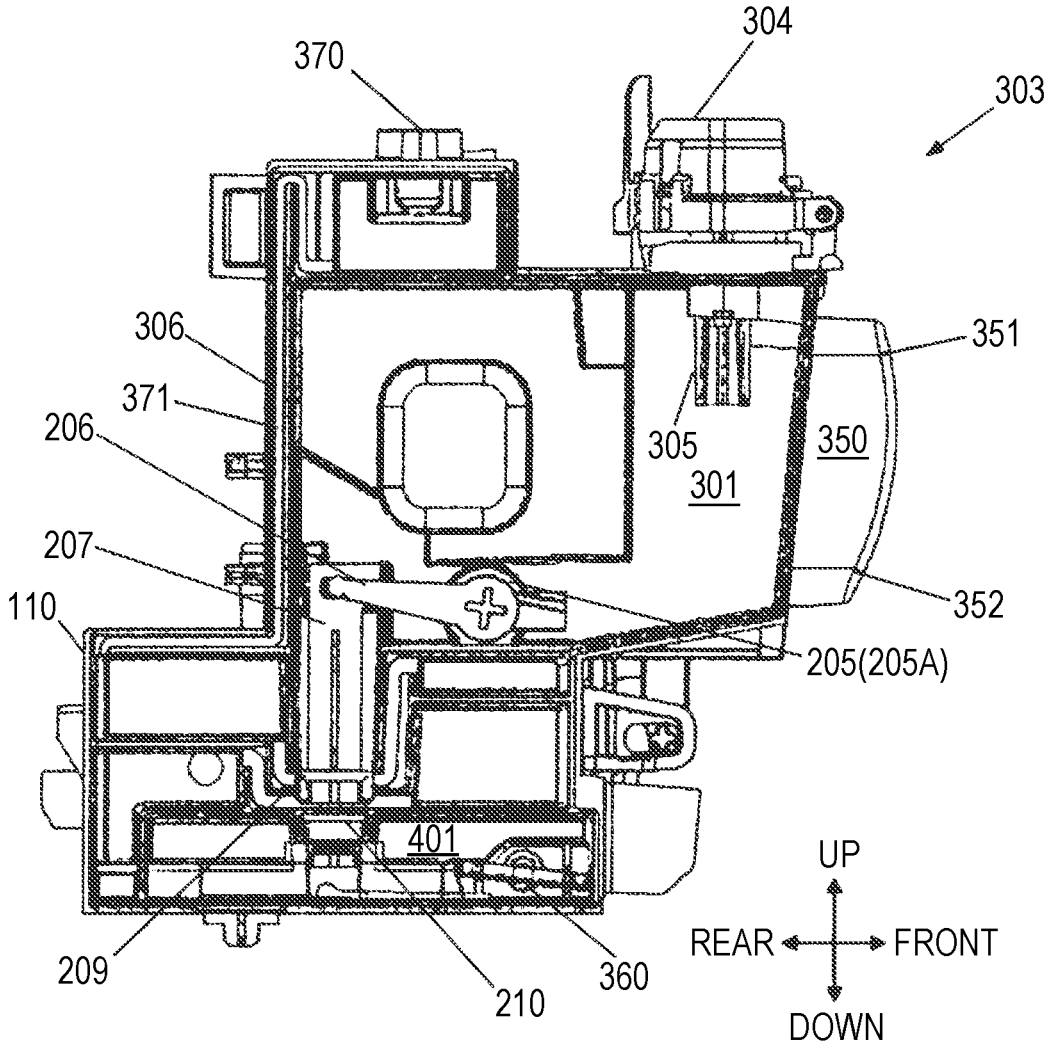
FIG. 2 is a left side view of an ink tank 303 of the related art in a state where a cap 304 is in a closed position.
Figure 3:
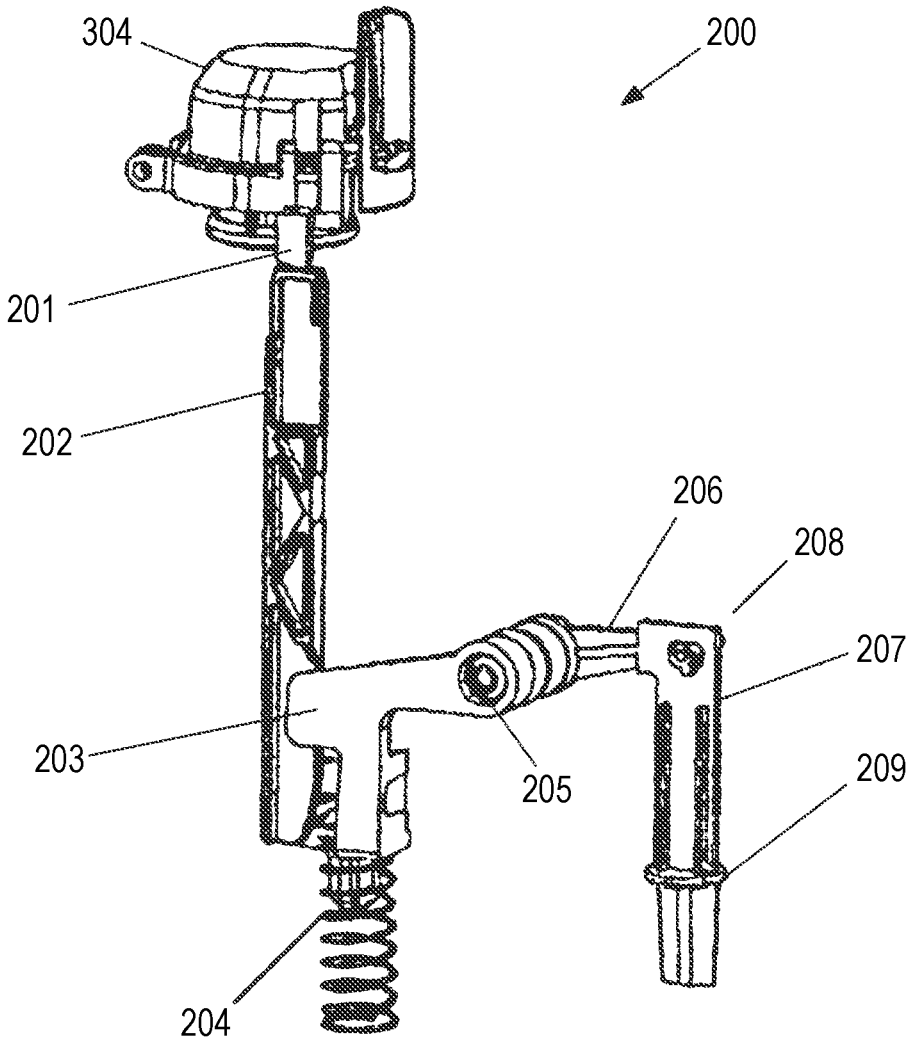
FIG. 3 is a perspective view illustrating only a link mechanism 200 used in the ink tank 303 of the related art.
Figure 4A:
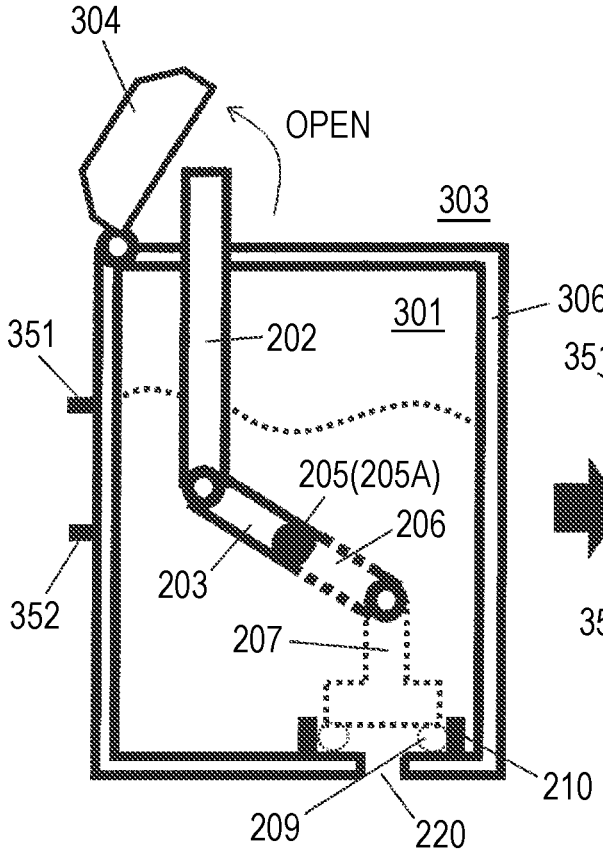
FIGS. 4A and 4B are schematic views illustrating an operation of the ink tank 303 of the related art in a simplified manner, where
Figure 4B:
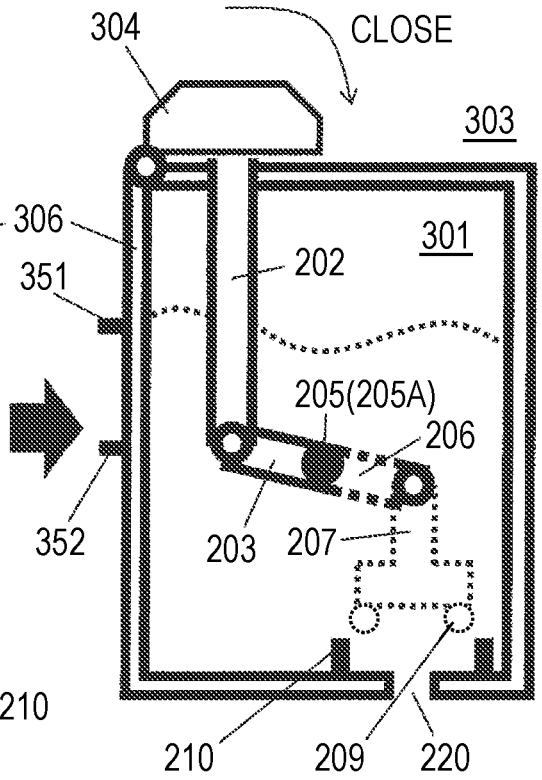

In the above-described related-art ink tank structure, the link mechanism must connect the parts provided inside the ink tank and the parts provided outside the ink tank. Specifically, it is necessary to connect the second lever arm arranged outside the ink tank to the rotation shaft 205 of the first lever arm 206 provided in the first ink chamber. Therefore, a resin right wall forming the first ink chamber 301 is provided with a through hole 205A through which the rotation shaft 205 penetrates and the rotation shaft 205 extends from the inside of the first ink chamber 301 toward the outside of the ink tank through the through hole 205A. Further, the rotation shaft 205 and the through hole 205A are arranged below the lower limit indicator 352. Therefore, when a maximum amount of ink which can be stored in the ink tank 303 is stored, that is, when a liquid level of the ink is at the upper limit indicator 351, the rotation shaft 205 and the through hole 205A are located below the ink liquid level. Therefore, even when the rotation shaft 205 and the through hole 205A are sealed by a sealing member such as an O-ring, there is a risk that the ink in the ink tank 303 may leak out of the ink tank from the through hole 205A due to aged deterioration or deformation of the sealing member.

Therefore, one illustrative aspect of the disclosure has been made to solve the above-explained problems.

Hereinafter, an illustrative embodiment of the disclosure will be described with reference to FIGS. 5 to 8B. It goes without saying that the illustrative embodiment described below is merely an example of the disclosure and the illustrative embodiment of the disclosure can be appropriately changed without changing the gist of the disclosure.

Figure 5:
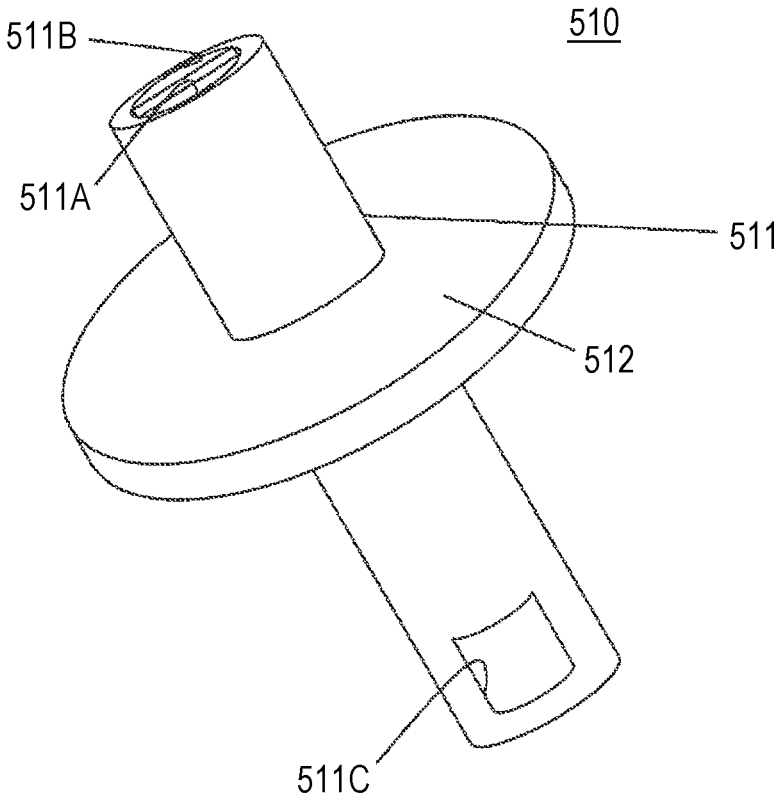
FIG. 5 is a perspective view of an injection cylinder 510 used in an ink tank 500 of an illustrative embodiment.
Figure 6:
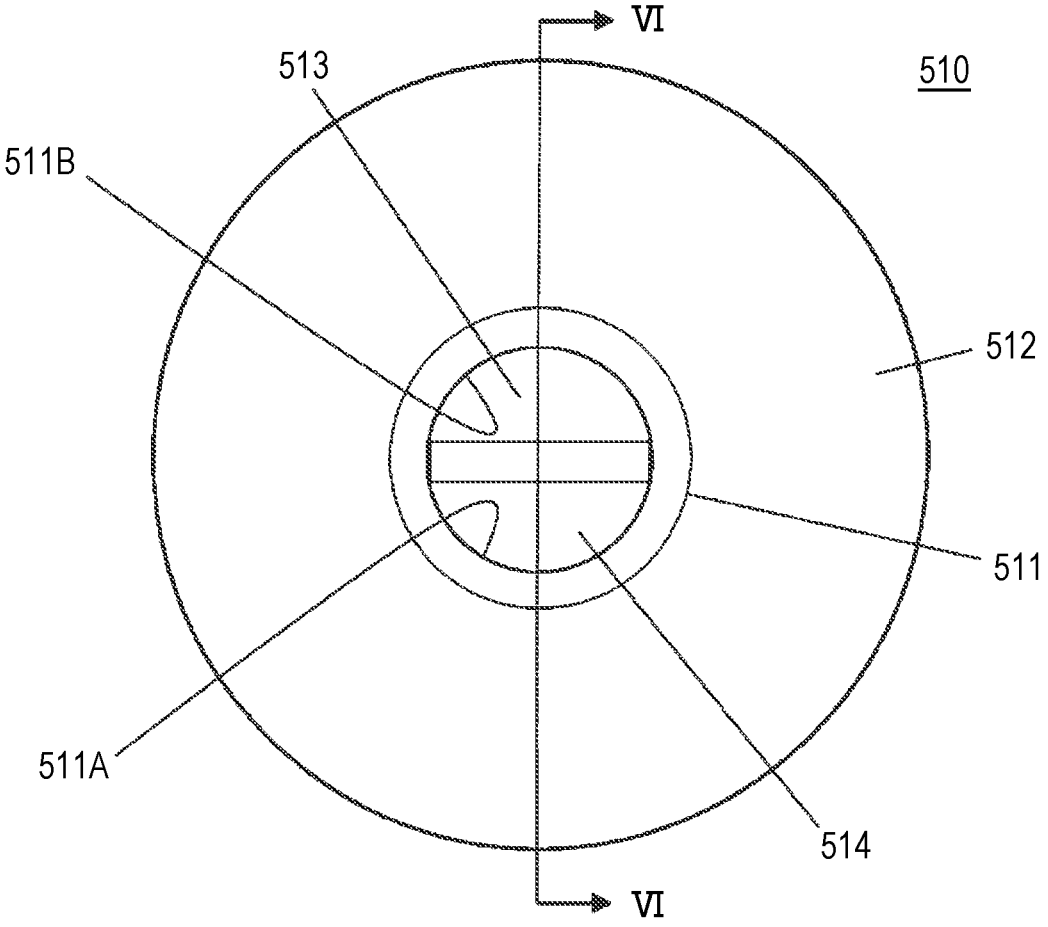
FIG. 6 is a plan view of the injection cylinder 510 illustrated in FIG. 5 as viewed from above.
Figure 7:
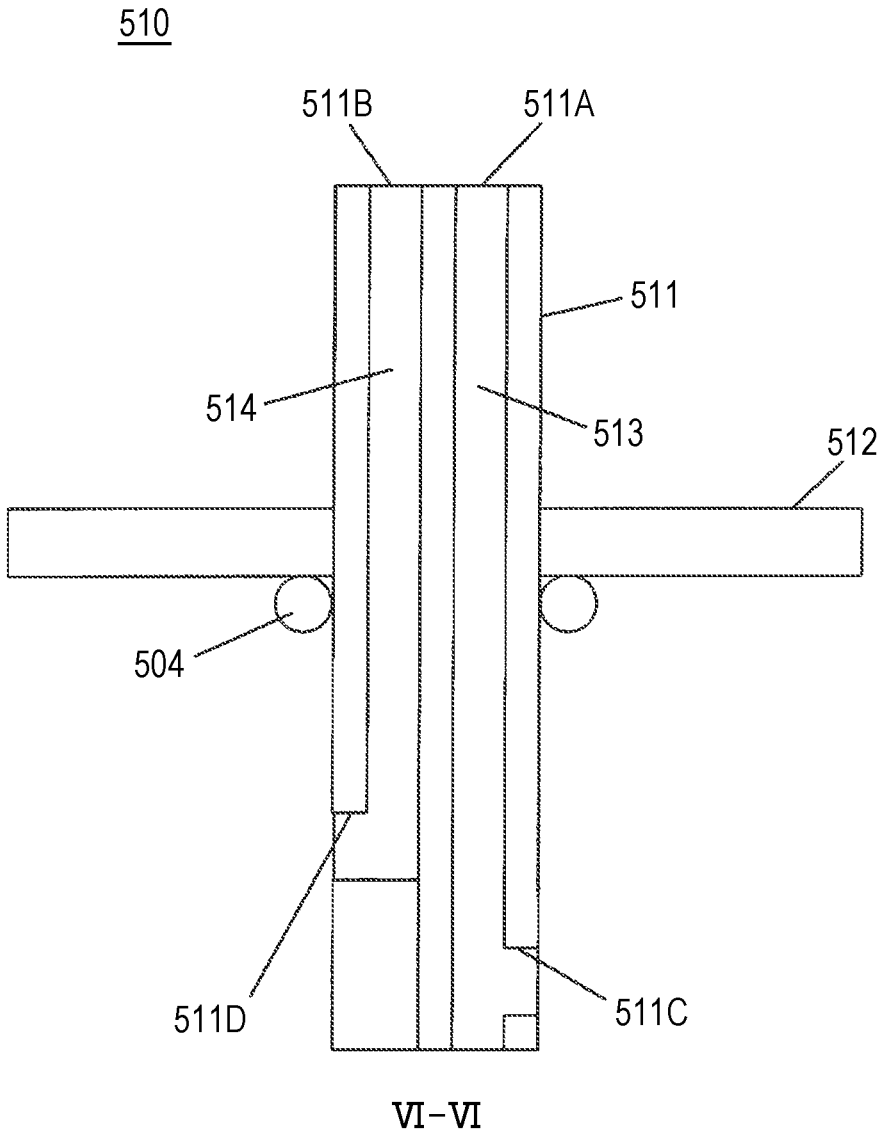
FIG. 7 is a cross-sectional view of the injection cylinder 510 illustrated in FIG. 6 cut along the VI-VI line and viewed from the side.
Figure 8A:
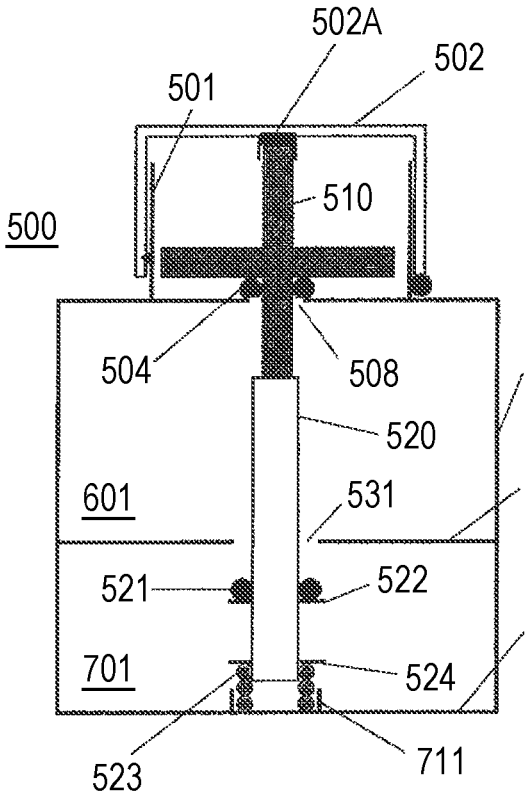
FIGS. 8A and 8B are schematic views illustrating an operation of the ink tank 500 of the illustrative embodiment in a simplified manner, where
Figure 8B:
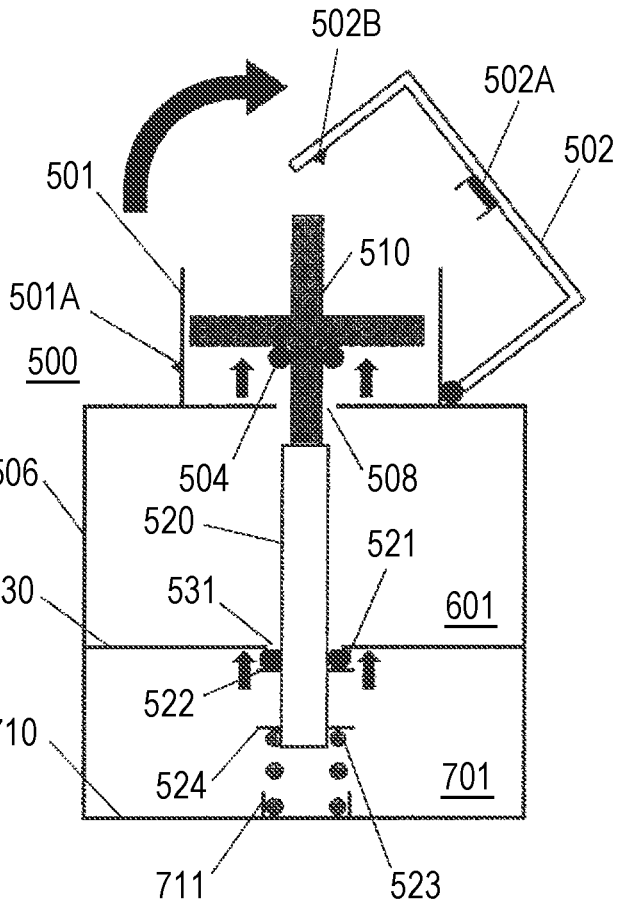

As described above, FIG. 5 is a perspective view of an injection cylinder 510 used in an ink tank 500 of the illustrative embodiment. FIG. 6 is a plan view of the injection cylinder 510 illustrated in FIG. 5 as viewed from above. FIG. 7 is a cross-sectional view of the injection cylinder 510 illustrated in FIG. 6 cut along the VI-VI line and viewed from the side. FIGS. 8A and 8B are schematic views illustrating an operation of the ink tank 500 of the illustrative embodiment in a simplified manner, where FIG. 8A illustrates a schematic view of a state in which a valve body 520 opens a communication passage 531 by pushing the valve body 520 downward by a cap 502 in a closed position and FIG. 8B illustrates a schematic view of a state in which the valve body 520 seals the communication passage 531 by separating the cap 502 in an open position from the injection cylinder 510.

The ink tank 500 described below is used for an inkjet recording apparatus which is an example of an image recording apparatus and the inkjet recording apparatus includes an inkjet recording type recording head 310 which is an example of a liquid consumption device.

As illustrated in FIGS. 8A and 8B, in the ink tank 500, the cap 502 is attached such that it can rotatably open or close the injector 501 of an ink tank body 506 having a substantially rectangular parallelepiped shape. An inner top surface of the cap 502 is provided with a sealing portion 502A which seals upper end openings 511A and 511B (see FIGS. 5 and 6) of the injection cylinder 510, which will be described below, when the cap 502 is in the closed position. Further, on an inner side surface of the cap 502, an engaging portion 502B which engages with an engaged portion 501A provided on an outer surface of the injector 501 is provided. The cap 502 is held in a closed position in a state where the engaging portion 502B of the cap 502 and the engaged portion 501A of the injector 501 are engaged.

The ink tank body 506 includes the injector 501, a first ink chamber 601, and a second ink chamber 701. Further, an opening 508 is provided in the injector 501 and the injection cylinder 510, which will be described later, is inserted into the first ink chamber 601 so as to penetrate the opening 508. Further, an inside of the ink tank body 506 is divided into the first ink chamber 601 and the second ink chamber 701 by a partition wall 530 extending in a horizontal direction. The second ink chamber 701 is arranged below the first ink chamber 601 and the first ink chamber 601 and the second ink chamber 701 are communicated with each other by the communication passage 531 provided in a partition wall 530. Further, the ink tank body 506 includes an ink outlet, an atmospheric communication passage, and an atmospheric communication port. The ink outlet for supplying the ink in the second ink chamber 701 to the recording head 310 is provided in the second ink chamber 701. Further, the ink tank body 506 is also provided with the atmospheric communication passage having an atmospheric communication port at an end thereof for taking in air outside the ink tank 500 inside the second ink chamber 701. In FIGS. 8A and 8B, the ink outlet, the atmospheric communication passage, and the atmospheric communication port are not illustrated.

Next, a structure of the injection cylinder 510 (an example of a slide member) will be described in detail with reference to FIGS. 5 to 7. The injection cylinder 510 includes a cylindrical cylinder portion 511 having two independent flow paths 513 and 514 inside and a flange portion 512 having a diameter larger than a diameter of the cylinder portion 511 around the cylinder portion 511. Further, by inserting the cylinder portion 511 into a sealing member (an example of a second sealing member) 504 composed of an O-ring or the like, the sealing member 504 is arranged on a lower surface side of the flange portion 512. At an upper end portion (an example of first end) of the cylinder portion 511, two upper end openings 511A and 511B (an example of first end side opening) communicating with each of the flow paths 513 and 514 are provided. Further, a lower end portion (an example of second end) of the cylinder portion 511 is also provided with two lower openings 511C and 511D (an example of second end side opening) communicating with each of the flow paths 513 and 514. When injecting ink into the ink tank 500, a user connects a supply port of an ink bottle (not illustrated) containing the ink to an upper end portion of the injection cylinder 510. Then, the ink in the ink bottle enters through one upper end opening 511A corresponding to one flow path (for example, flow path 513) and flows out into the ink tank 500 from one lower opening 511C corresponding to the flow path. On the other hand, air in the ink tank 500 enters the other flow path through one lower opening 511D corresponding to the other flow path (for example, the flow path 514), and then the air is discharged into the ink bottle through the upper end opening 511B corresponding to the other flow path. As a result, the ink in the ink bottle is replaced with the air in the ink tank 500, so that the ink in the ink bottle is supplied into the ink tank 500.

Next, the structure of the valve body 520 will be described. The valve body 520 includes a sealing member (an example of a first sealing member: O-ring or the like) 521 made of an elastic body such as rubber, a first flange portion 522 for positioning the sealing member 521, and a second flange portion 524 for positioning a compression spring 523, which will be described below, and transmitting the pressure applied by the compression spring 523 to the valve body 520. Further, the valve body 520 penetrates the communication passage 531 of the partition wall 530 which separates the first ink chamber 601 and the second ink chamber 701 of the ink tank 500. The valve body 520 is provided so as to be able to move up and down in a state of penetrating the communication passage 531.

The sealing member 521 opens or closes the communication passage 531 of the partition wall 530 from a side of the second ink chamber 701. The sealing member 521 is arranged and positioned on an upper surface side of the first flange portion 522 and cannot move below the first flange portion 522.

The compression spring 523 is provided between the second flange portion 524 and a bottom wall 710 of the second ink chamber 701 and applies a force to push up the valve body 520 upward through the second flange portion 524. A spring seat 711 for preventing the movement of the compression spring 523 is provided on the bottom wall 710 of the second ink chamber 701 in which one end portion of the compression spring 523 is arranged.

Next, an operation of the ink tank 500 of the illustrative embodiment will be described with reference to FIGS. 8A and 8B. As is clear from FIG. 8A, when the cap 502 is in a closed position with respect to the injector 501 of ink tank 500, that is, when the engaging portion 502B of the cap 502 is engaged with the engaged portion 501A of the injector 501, by pressing the injection cylinder 510 downward with the cap 502, the valve body 520, which is in contact with a lower end of the injection cylinder 510, is also pressed downward against the compression spring 523. In this case, the sealing member 504 of the injection cylinder 510 seals the opening 508. Further, the sealing portion 502A provided on a back top surface of the cap 502 also seals the upper end openings 511A and 511B of the injection cylinder 510. On the other hand, the sealing member 521 of the valve body 520 opens the communication passage 531 of the partition wall 530 which partitions the first ink chamber 601 and the second ink chamber 701. Therefore, the first ink chamber 601 and the second ink chamber 701 are in a communicating state. When ink is consumed by the recording head 310 due to image recording on a recording sheet, air is taken into the second ink chamber 701 from the atmospheric communication port and the atmospheric communication passage (not illustrated) and the ink in the second ink chamber 701 is supplied from the ink outlet (not illustrated) toward the recording head 310.

On the other hand, as is clear from FIG. 8B, when the cap 502 is in the open position with respect to the injector 501 of the ink tank 500, that is, when a user tries to replenish the ink tank 500 with ink, the user disengages the engaging portion 502B of the cap 502 and the engaged portion 501A of the injector 501. In this case, since the cap 502 is separated from the injection cylinder 510, the injection cylinder 510 cannot be pressed downward. Then, the valve body 520, which is in contact with the lower end of the injection cylinder 510, is also lifted upward by the compression spring 523. In this case, the sealing member 504 of the injection cylinder 510 opens the opening 508. Further, the sealing portion 502A provided on the back top surface of the cap 502 also opens the upper end openings 511A and 511B of the injection cylinder 510. On the other hand, the sealing member 521 of the valve body 520 seals the communication passage 531 of the partition wall 530 which separates the first ink chamber 601 and the second ink chamber 701. Therefore, the communication between the first ink chamber 601 and the second ink chamber 701 is cut off. Since the cap 502 is in the open position, the user can replenish the ink in the ink tank 500 as described above.

As is clear from the above description, in the ink tank 500 of the disclosure, it is possible to provide an ink tank that can open or close a valve inside the ink tank with a simple structure without using a rotation shaft or a complicated link mechanism for connecting the inside and outside of the ink tank as in an ink tank 303 of the related art. According to this ink tank structure, unlike the ink tank 303 of the related art, it is not necessary to provide a through hole 205A through which a rotation shaft 205 penetrates on a side wall of the ink tank 303, so that ink leakage can be reduced.

Modification Example

Figure 9A:
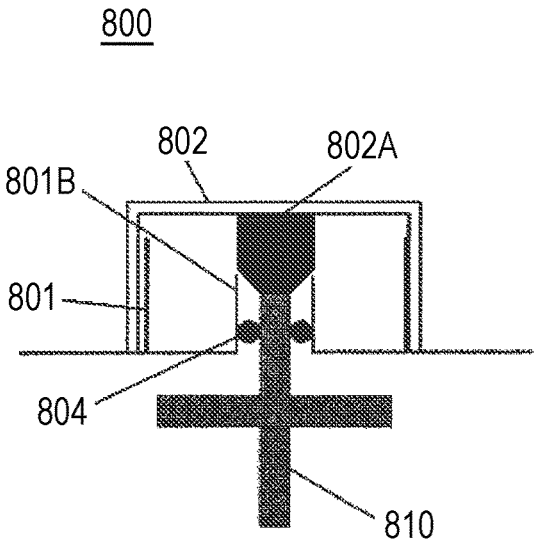
FIGS. 9A and 9B are schematic views illustrating an operation of an ink tank 800, which is a modification example of the illustrative embodiment, in a simplified manner, where
Figure 9B:
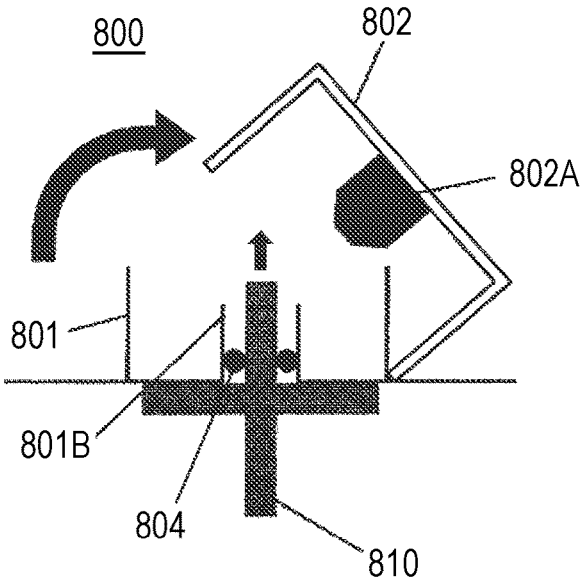

FIGS. 9A and 9B are views illustrating a part of an ink tank 800, which is a modification example of the ink tank 500 illustrated in FIGS. 8A and 8B. FIG. 9A illustrates a schematic view of a state in which a cap 802 in a closed position pushes down an injection cylinder 810 and FIG. 9B illustrates a schematic view of a state in which the cap 802 in an open position is separated from the injection cylinder 810.

The ink tank 800 is the same as the ink tank 500 except for the structure of the cap 502, the injector 501, the sealing member 504, and the injection cylinder 510 of the ink tank 500. Therefore, here, only the portion of the structure in which the ink tank 800 is different from the ink tank 500 will be described. Although not illustrated in FIGS. 9A and 9B, an outer peripheral surface of the injector 801 of the ink tank 800 is also provided with an engaged portion (not illustrated) similar to the engaged portion 501A provided on the outer peripheral surface of the injector 501 of the ink tank 500 and an inner side surface of the cap 802 is also provided with an engaging portion (not illustrated) similar to the engaging portion 502B provided on the inner side surface of the cap 502 of the ink tank 500.

A sealing portion 802A is provided on an inner top surface of the cap 802. When the cap 802 is in the closed position, the sealing portion 802A seals two upper end openings (not illustrated) of the injection cylinder 810. The injector 801 is provided with a communication cylinder portion 801B into which the injection cylinder 810 is inserted so as to be vertically movable. A sealing member (an example of a third sealing member) 804 composed of an O-ring or the like is fixedly arranged on an inner peripheral surface of a communication cylinder portion 801B. Therefore, even when the injection cylinder 810 moves up and down in the communication cylinder portion 801B, except for an ink flow path and an atmospheric flow path included in the injection cylinder 810, the outside of the ink tank 800 and the first tank chamber are not communicated with each other. Therefore, when the cap 802 is in the closed position and two upper end openings (not illustrated) of the injection cylinder 810 are sealed by the sealing portion 802A, the first ink chamber is sealed and the sealing efficiency is improved. The injection cylinder 810 also moves up and down in conjunction with the opening and closing of the cap 802, and the valve body (not illustrated) arranged below the injection cylinder 810 also moves up and down. Even with this structure, the same effect as the ink tank 500 can be obtained.

Further, in the illustrative embodiment described above, the slide member and the valve body are described as independent bodies, but both may be configured as one.

Further, the slide member does not have to have two flow paths. In this case, the ink tank 800 of the modified example illustrated in FIGS. 9A and 9B is provided with another ink injection port for injecting ink into the first ink chamber. The ink injection port also has a configuration that can seal and open the first ink chamber.

What is claimed is:

1. An ink tank configured to supply liquid to an apparatus having a liquid consumption device, the ink tank comprising:

a first liquid storage chamber configured to store liquid to be supplied to the liquid consumption device;

a second liquid storage chamber communicating with the first liquid storage chamber through a communication passage, the second liquid storage chamber having a liquid outlet supplying liquid to the liquid consumption device;

an injector having an opening supplying liquid to the first liquid storage chamber;

a cap movable between an open position and a closed position with respect to the injector;

a slide member which is inserted so as to be vertically movable with respect to the opening of the injector, the slide member being moved downward by the cap in the closed position;

a valve body which is vertically movably inserted in the communication passage between the first liquid storage chamber and the second liquid storage chamber, the valve body comprising a first sealing member configured to seal the communication passage, the first sealing member opening the communication passage by moving downward together with the slide member moved downward by the cap in the closed position; and an urging member configured to always urge the valve body upward.

2. The ink tank according to claim 1, wherein the slide member includes a second sealing member configured to seal the opening, and wherein when the cap is in the open position, the valve body is raised by the urging member, so that the first sealing member seals the communication passage, and the second sealing member opens the opening by moving the slide member upward as the valve body rises.

3. The ink tank according to claim 1, wherein the slide member includes two independent flow paths extending from a first end arranged outside the ink tank toward a second end arranged inside the ink tank when the cap is in the open position, the second end being opposite to the first end, the first end of the slide member having two first-side openings communicating with respective flow paths, and the second end of the slide member having two second-side openings communicating with respective flow paths.

4. The ink tank according to claim 1, wherein the slide member includes a third sealing member configured to always maintain a sealed state of the opening, the slide member being inserted into the opening so as to be vertically movable.

5. The ink tank according to claim 4, wherein the slide member includes two independent flow paths extending from a first end arranged outside the ink tank toward a second end arranged inside the ink tank when the cap is in the open position, the second end being opposite to the first end, the first end of the slide member having two first-side openings communicating with respective flow paths, and the second end of the slide member having two second-side openings communicating with respective flow paths.

6. The ink tank according to claim 3, wherein the cap comprises a sealing portion configured to seal the first-side opening when the cap is in the closed position.

7. The ink tank according to claim 5, wherein the cap comprises a sealing portion configured to seal the first-side opening when the cap is in the closed position.

8. The ink tank according to claim 1, wherein the slide member and the valve body are composed of separate independent members.

9. An image recording apparatus comprising:

a liquid consumption device; and the ink tank according to claim 1 configured to supply liquid to the liquid consumption device.

* * * * *